US005433090A

United States Patent [19]

Santiago

[11] Patent Number: 5,433,090

[45] Date of Patent: Jul. 18, 1995

[54] VARIABLE FINGER RING WITH BIASED SHANK AND METHOD OF MAKING SAME

[76] Inventor: Raoul M. Santiago, 957 Marion Pl., Akron, Ohio 44314

[21] Appl. No.: 46,456

[22] Filed: Apr. 16, 1993

[51] Int. Cl.[6] ..... A44C 17/02

[52] U.S. Cl. ..... 63/29.1

[58] Field of Search ..... 63/26, 29.1, 15

[56] References Cited

U.S. PATENT DOCUMENTS

| | | | |
|---|---|---|---|
| D. 36,484 | 8/1903 | Horth | 63/15 |
| D. 203,792 | 2/1966 | Mills | 63/29.1 |
| 881,802 | 3/1908 | Hunt | 63/15 |
| 1,152,340 | 8/1915 | Obsboum | 63/29.1 |
| 1,186,271 | 6/1916 | Block | 63/29.1 |
| 1,548,645 | 8/1925 | Akeson | 63/15 |
| 1,548,646 | 8/1925 | Akeson | 63/15 |
| 1,553,198 | 9/1925 | Stern . | |
| 1,721,071 | 7/1929 | Chernick . | |
| 1,971,265 | 8/1934 | King | 63/15 |
| 2,028,284 | 1/1936 | Jackson | 63/26 |
| 2,072,440 | 3/1937 | Bauer et al. | 63/29.1 |
| 2,585,183 | 2/1952 | Stern | 63/15 |
| 3,307,375 | 3/1967 | Estrin | 63/15 |
| 3,653,227 | 4/1972 | Ricci | 63/29.1 |
| 3,693,376 | 9/1972 | Willner | 63/15 |
| 3,959,989 | 6/1976 | Bhandia | 63/15.65 |
| 4,220,017 | 9/1980 | Freeman | 63/15 |
| 4,726,200 | 2/1988 | Carter | 63/15 |
| 5,133,195 | 7/1992 | Appelbaum | 63/29.1 |
| 5,188,679 | 2/1993 | Kretchmer | 63/15 |

FOREIGN PATENT DOCUMENTS

| | | | |
|---|---|---|---|
| 180882 | 9/1962 | Sweden | 63/15 |
| 22282 | of 1914 | United Kingdom | 63/29.1 |

OTHER PUBLICATIONS

Deutsche Goldschmiede-Zeitung Jul. 1959 p. 367.

Copyrighted Photocopy-Ex. A-dated Mar. 30, 1993.

*Primary Examiner*—Michael J. Milano

*Attorney, Agent, or Firm*—Joseph H. Taddeo

[57] ABSTRACT

A finger ring with an opening in the shank for insertion and removal of gems, a ball, bead or other ornamental jewelry in the ring. The shank has upright end portions with a bezel platform to hold a bead or ball by external compression of the shank ends upon the bead or bell. Alternatively, the end portions have a notch grooved in the end portions; and an independent bezel with sidewalls and ears projecting from the sidewalls is adapted for insertion in the ring and snaplocked in position with the ears within the complementary notches.

4 Claims, 2 Drawing Sheets

VARIABLE FINGER RING WITH BIASED SHANK AND METHOD OF MAKING SAME

FIELD OF THE INVENTION

The invention relates to a finger ring adapted for interchanging an ornamental ball., bead or gems in the ring and, more particularly, a ring with an open shank, spaced apart ends and means associated with the ends for removably mounting various ornaments or gems in the ring.

BACKGROUND OF THE INVENTION

Various finger rings adapted for interchanging gemstones are known in the prior art., For example, U.S. Pat. No. 873,156 to C. Moe, relates to a ring for displaying gems. The ring has a cut shank and separable, resilient holding prongs for rapid removal and replacement of different gems having like sizes and shapes.

U.S. Pat. No. 3,693,376 to Willner, discloses a finger ring with open shank and a housing cast onto each of the shank ends for holding an ornamental ball within the opposed housings by resilience of the shank.

These prior art rings for interchangeable gemstones are found to be somewhat complex and, therefore, they are expensive to manufacture. The retaining portion may not be sufficiently durable to withstand repeated insertion and removal of the gems. As such, those prior art rings were subject to malfunction and breakage. Additionally, the shanks were subject to loss of resilience or tension, due to lack of any specialized process for manufacturing the shanks.

An object of the invention is to provide a finger ring for interchanging gemstones which could be inexpensively manufactured. Such ring would have a basic simplicity and no moving parts, but still provide the attraction and allure of the more expensive jewelry.

Another object of the invention is to provide a finger ring which can be used readily by the wearer by easy assembly and interchangeability of gemstones of all sizes and cuts.

A still further object of the invention is to enhance the wearer's ability to alter the ring stone to match a particular style of dress, occasion or the person's mood.

Another object of the invention is to enable construction of a highly desirable fashion ring of utmost quality which would benefit the user by exemplary performance over a long service life.

Still another object of the invention is construction of a resilient ring shank such that the shank provides an inward compression to prevent inadvertent displacement of a gemstone, ball, bead or other ornamental member from its assembled position.

Yet another object of the invention is to design a spring tension in the ring shank whereby the shank will return to its original shape after a gemstone, ball or bead is removed from the ring.

A still further objective is to provide a method of manufacture for a ring to accommodate interchangeable gems, which shank will have a range from 70% to 80% tension and still have a high degree of flexibility.

SUMMARY OF THE INVENTION

The foregoing objects, as well as other objects and advantages, are achieved by the present invention of a finger ring for interchangeable gems or the like. The ring band or shank has a generally arcuate or circular form. While the shank is resilient, there is still a degree of flexibility maintained in the shank. The shank has an opening and that opening is defined by spaced apart shank ends, which are segments or end portions of the shank which are bent upward or outward from the shank.

As end portions project outward from the shank, the pair of end portions stand in opposed, essentially parallel alignment; and the end portions are biased inward by resilience of the shank.

The variable ring of the invention includes a means for retaining the gemstones, ball or bead within said within the opening defined by the shank ends. The means for retaining uses an inward compression, from the resilience of the shank and the resultant inward bias of the end portions.

The means for retaining includes a pair of opposed bezel platforms, each bezel platform being affixed to an end portion near the shank end. The bezel platforms are shaped as cut cylinders and define an internal cavity. Each platform has an outer circular edge.

In this way, a generally spherical, ornamental bead is insertable in the cavities of the bezel platforms, since the diameter of the bead is greater than the distance between the circular edges of the bezel platforms.

In a second embodiment, the finger ring includes a bezel having sidewalls and an open top and open bottom. The bezel is generally rounded to encase the gemstone or other ornamental item. A pair of rounded ears project from sidewalls of the bezel and the ears are graduated from a wider portion near said open top of the bezel to a narrow portion near the open bottom of the bezel.

A notch is grooved in each of the end portion near the shank end. The notches are rounded with a wide upper portion near the shank end and a narrower portion closer to the shank, whereby the bezel is adapted to snap lock into, and be retained in the ring by, the inward compression of the resilient shank and resultant inward bias of the end portions against the bezel ears.

The third embodiment is a combination of the foregoing first and second embodiments in that, the end portions include both bezel platforms integrally formed in the shank and notches grooved within the circular edges of the platforms. Thus the ring of the third embodiment is adapted to receive and hold either a spherical ball or bead, or a bezel containing a gemstone of any shape.

DETAILED DESCRIPTION OF THE PREFERRED EMBODIMENT

Figure 1:
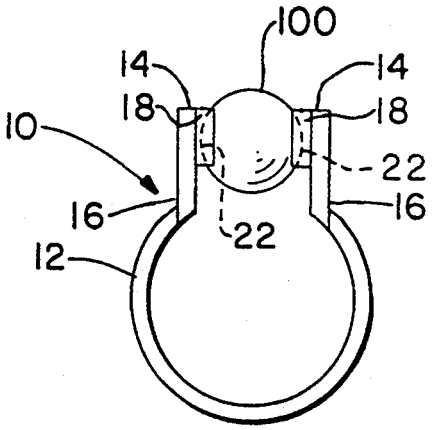
FIG. 1 is a front elevation of the first embodiment of the finger ring made in accordance with this invention.

Referring now to FIG. 1 of the drawings, there is shown the finger ring 10 for interchangeable gems, which may be an ornamental ball, bead or the like. The ring has an arcuate or circular shank 12. The shank 12 is resilient having a flexible tension or resiliency in a range from 70% to 80% resiliency, more preferably, between 74% to 77% resiliency, on the basis of 100% being equivalent to total hardness of the ring shank.

This resiliency or spring tension is accomplished by work hardening as opposed to temper hardening the shank. If the ring shank for the use disclosed herein is hardened to 100%, there will be a tendency of the shank to crystallize and crack. The ideal is to have a soft inner core with an outer casing which is hardened, but not hardened to crystallization.

It will be understood that a ring manufactured by the process described below will have a tendency to return to its original shape when the ornamental ball 100, bead (not shown) or bezel containing a gemstone 102 is removed. This is a significant factor, for it allows interchangeability of gems in the ring over an extended lifetime.

The shank 12 has an opening which is defined by spaced apart shank ends 14. The shank ends 14 are formed by segments or end portions 16 of the shank 12 which are bent upward or outward from the shank 12. The end portions 16 project outward from the shank 12 to stand in opposed, essentially parallel alignment or relation. As a direct result of the resilience of the shank 12 itself, the end portions 16 are biased inward in that essentially parallel alignment.

In a fashion ring of the type described here, there must be a means for retaining gemstones 102 or the like in the ring. That means for retaining is achieved by means of an inward compression, where an ornamental ball 100 or a bead is held in place by compression of the shank ends against the surface of the ornamental ball or bead; or, in the alternative, the means for retaining may be a snaplocking system, wherein ears 32, shown in FIG. 5 and FIG. 6, formed on an independent bezel 24 snaplock within notches 38 grooved in each end portion 16.

Figure 2:
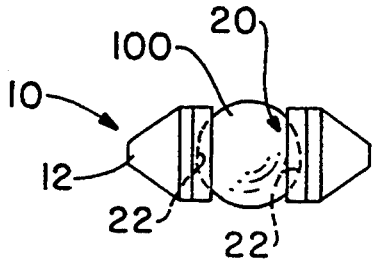
FIG. 2 is a top plan view of the ring shown in FIG. 1.

Referring to FIG. 1 and FIG. 2, which illustrate the first embodiment of the invention, the means for retaining comprises a pair of opposed bezel platforms 18, each platform being affixed to an end portion 16 near the shank end 14. The platforms 18 are shaped as cut cylinders and define an internal cavity 20. Each platform has a circumference or an outer circular edge 22, which is the part forcibly moved out of position when inserting an ornamental ball or bead in the ring.

As may be seen by reference to both FIG.1 and FIG. 2, the diameter of the spherical gem or ball 100 or other item of ornamental jewelry exceeds the distance between the circular edges 22 of the bezel platforms 18 and thus the gem or ball is held stationary in the internal cavity 20 of the bezel platform 18.

Figure 3:
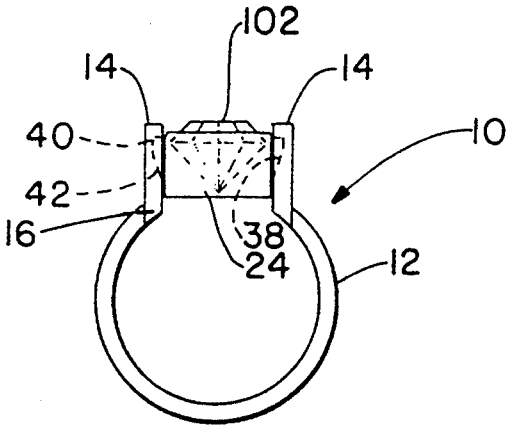
FIG. 3 is a front elevation of the second embodiment of the finger ring made in accordance with this invention.

Referring now to FIG. 3, there is shown a frontal view of the second embodiment of the invention wherein an independent bezel 24 surrounding a gem 102 is adapted to snaplock into end portions 16 of the shank ends 14. The important feature of the ring configuration in this embodiment is the fact that gems of any size and shape, (within reason), may be inserted into the ring. In other words, gems, stones or ornaments having dimensions 8×10 mm, 8×12 mm, etc., would be suitable for seating in the bezel 24 for insertion in the ring.

The bezel 24, shown in FIG. 3, FIG. 4, FIG. 5 and FIG. 6, is generally comprised of sidewalls 30 surrounding the gem 102 and has an open top 26 and open bottom 28. Rounded ears 32 project from the sidewalls 30 of the bezel 24 and the ears are graduated with a wider portion 34 of the ear near the open top and a narrow portion 36 of the ear near the open bottom 28 of the bezel 24. Meanwhile, each end portion 16 is provided with a rounded notch 38 in the end portion; and the rounded notches with a wider portions 40 near the shank end 14 and a narrower portion 42 nearer the shank 12 are adapted to receive ears 32 of the bezel 24 and snap lock the bezel 24 into the ring 10.

Figure 4:
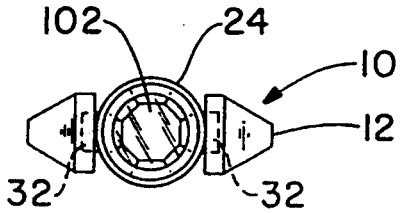
FIG. 4 is a top plan view of the ring shown in FIG. 3.
Figure 5:
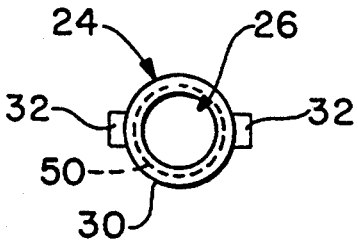
FIG. 5 is a top plan view of the bezel with the ears projecting from the sides thereof.
Figure 6:
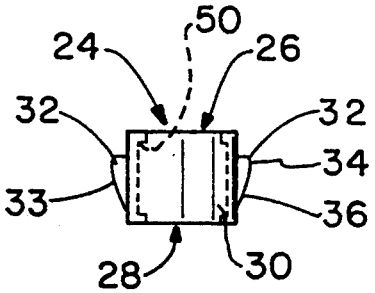
FIG. 6 is a side view of the bezel of FIG. 5.

FIG. 3 and FIG. 4 indicate that graduation of the ears 32 facilitates insertion of the bezel 24 into the ring. FIG. 5 and FIG. 6 further clarify positioning and dimensioning of the ears 32 which project from sidewalls 30 of the bezel 24, and, how the ears are adapted to be insertable in the notches 38. The gem 102 is generally mounted in the bezel within seat 50 of the bezel.

Figure 7:
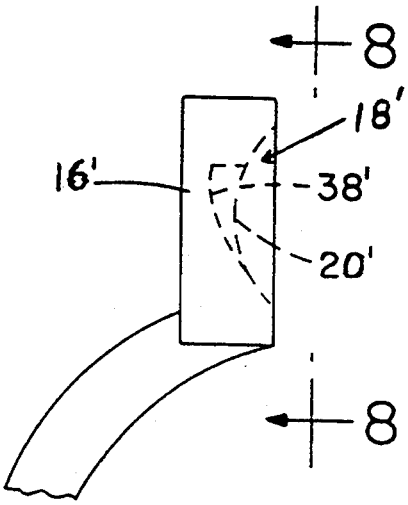
FIG. 7 is a front enlargement of a partial view of the third embodiment of the ring of FIG. 1,, wherein the third embodiment incorporates both a bezel platform integral with the end portion and a notch grooved in the end portion.
Figure 8:
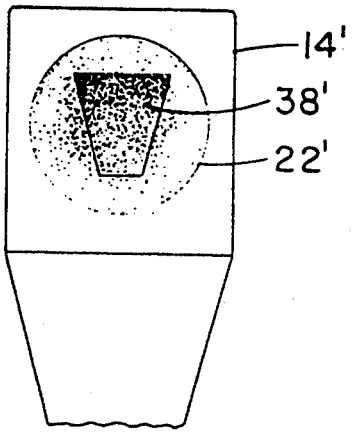
FIG. 8 is an enlarged side view along line 8—8 of FIG. 7, further illustrating the bezel platform formed as a depression in the end portion and the notch grooved within the circular edge of the integral bezel platform.

A third embodiment for the invention is illustrated in FIG. 7 and FIG. 8. The ring 10 of the invention is preferably constructed as a combination of the first two embodiments, shown in FIGS. 1–2 and FIGS. 3–4. That is, both the bezel platform 18′ and notch 38′ are integrally formed in the same end portion 16′, such that an ornamental ball 100 or a bead may be interchanged by use of the bezel platforms formed as hemispherical depressions in the end portion; or alternatively, gems encased in a bezel may be interchanged by snaplocking the bezel into notches 38′ of the very same ring shank. In this embodiment, a bezel platform 18′ is integrally formed in each end portion 16′ by formation of a cavity 20′ or a hemispherical depression therein; and a notch 38′ is then grooved within the circular edge 22′ of each cavity to receive an ear of the bezel.

The ring disclosed herein can thus accommodate a wide variety of ornamental or decorative jewelry, yet the ring retains a simplified construction and assembly. In the second and third embodiments which incorporate the bezel, the bezel and ring are capable of retaining round, oval, marquis cut, pear shaped, emerald cut and cushion shaped gems.

I have found a unique process for making the ring shank and shank ends. The objective in manufacture of the ring shank is to provide a resilience or memory factor, so that the ring shank will return to its original shape due to spring tension, after having been stretched by insertion of a gem, an ornamental ball or other decorative item. The shank is generally made from a wire or ribbon segment chosen from the class comprised of gold, silver, brass, platinum or stainless steel.

The shank is blanked to proper size and provided with an ornamental or plain tab. A specially designed dual-roller, having the same shape as the wire or ribbon used in the shank, rolls the prepared blank around a mandrel to form the ring according to finger size. The dual-roller tool also provides fundamental tension to the ring. The ring shank is then tumbled for one-half to three and one-half hours to attain a work-hardness of three-quarter (¾), or seventy-five percent, (75%), hardness. The ring is then polished in ordinary fashion.

Special distinct characteristics of the manufacturing process lie in the rolling process to shape the ring shank. The standard die-forming process shapes metal around a mandrel, thereby pressure squeezing the inner circumference and stretching the outer circumference to conform, leaving the outer molecular surface porous and somewhat torn. As a consequence, the ring shank may be too brittle for the use described herein.

Shaping the ring shank by a roll tool designed for this purpose has been found to be preferable. Thus, the wire is placed on a ring mandrel and shaped by a roll tool having two rollers or wheels, which effectively rolls the wire around the mandrel to form the ring shank. The ring mandrel gives the outer surface or casing of the ring shank a partial hardness.

The rolling method to form the shank around a mandrel, maintains the molecular integrity of the shank, because the ring shank is formed without stretching molecules on the outer surface of the shank. The roller tool effectively burnishes closed the outer surface of the metal, forming a flexible outer casing (a uniform case hardening) and a soft inner core . This novel method provides the shank with a firm, but gentle, spring tension, governed by the casing (inner and outer dimension) which tension is equal to one-half ring size. The soft core resists crystallization and cracking. The result of this process is that when the ring shank is stretched to receive the gem or other ornamental item, only the softer inner core is affected, but not the hardened outer casing.

The ring shank ends are then bent outward by placing the shank in a jig or die to achieve the bend forming end portions which extend outward from the shank in opposed, essentially parallel alignment. An important feature of the ring thus formed is that parallel alignment of the outward extending end portions and the fact that end portions are biased inward by the spring tension or resilience of the shank. The flat exterior surface of each end portion allows application of a carved or sculpted design to that surface.

Generally, burnishing is the reformation of metal without diminishing the metal. The succeeding steps of the process of making the ring involve burnishing the shank.

This burnishing of the ring is accomplished when the ring shank formed on the mandrel is placed in a vibrating tumbler with steel shot, soap and water, and vibrated for a period from one-half to three and one-half hours.

The tension of the shank obtained by a vibrating tumbler has been found superior and more efficient to that which is obtained by use of a barrel tumbler; and, tests indicate that ring shank tension is maximized with vibration in the tumbler between one-half to three and one-half hours depending on the initial hardness of the wire material used for the ring shank.

Respective to the first embodiment of the invention, bezel platforms are affixed to each of the end portions. Each bezel platform is shaped as a cut cylinder which defines an internal cavity the periphery of which is an outer circular edge.

For the second embodiment, notches are grooved in each end portion near the shank end, with a wider portion near the shank end and a narrower portion near the shank. A bezel formed to have rounded sidewalls, an open top and an open bottom, and ears projecting from the sidewalls thereof is adapted to be snaplocked in the ring. Each of the ears is graduated from a wider portion near the open top to a narrow portion near the open bottom of the bezel.

The bezel includes a seat portion for mounting or encasing a gem in the bezel. By manual pressure, the bezel can be inserted into the ring, such pressure exerted upon the rounded, graduated ears against the end portions until the wider portion of each of the ears snap locks into the wider portion of the notches.

The third embodiment is constructed by carving essentially hemispheric depressions in each end portion near the shank end to form bezel platforms which are integral with the end portion. The depression define an internal cavity and have a circular edge at the periphery of the platform.

A notch is then grooved in each or the end portions near the shank end, each notch formed within the circular edge of the bezel platform.

A gem is mounted in the seat of the bezel formed to encase the gem. The bezel includes protruding ears and is adapted to snaplock into the notches of the end portions for interchanging gems.

In this third embodiment, the means for removably retaining gems in the ring comprises the inward compression of the end portions on an ornamental ball held in the cavities of the bezel platforms which are integrally formed in the end portions; or, alternatively the inward compression is upon the bezel with encased gem snaplocked in the ring.

The terms and expressions which used in the foregoing detailed description have been used as terms of description and not of limitation, and there is no intention in the use of such terms and expressions of excluding any equivalents of any of the features shown or described, or portions thereof, and it is recognized that various modifications are possible within the scope of the invention claimed.

I claim:

1. A finger ring for interchangeable gems, said ring having an arcuate, resilient shank with an opening defined by spaced apart shank ends, comprising:

said shank bent to form a pair of end portions, each end portion extending outward from the shank in opposed, essentially parallel alignment;

said end portions biased inward by resilience of the shank;

a pair of opposed bezel platforms, each of said pair integrally formed as a hemispherical depression in the shank ends; and each of said pair of bezel platforms defining an internal cavity and having a circular edge at the periphery of the platform;

a generally spherical ornamental gem having a diameter, said diameter greater than the distance between said edges, said platforms adapted for insertion of the gem in the cavities when the gem is pressed against the circular edges with manual force exceeding resilience of the shank;

a bezel having an open top, open bottom and sidewalls, said bezel generally rounded to encase a gem, the bezel further having a rounded ear projecting from both of the sidewalls thereof; each of said rounded ears graduated from a wider portion near said open top of the bezel to a narrow portion near said open bottom of the bezel; and a notch grooved in each said end portion near the shank end, within the circular edge of each said bezel platform, each notch having a wider portion near the shank end and a narrower portion near the shank adapting the bezel to snap lock into, and be retained in said ring.

2. A finger ring for interchangeable gems, said ring having an arcuate, resilient shank with an opening defined by spaced apart shank ends, comprising:

said shank bent to form a pair of end portions, each end portion extending outward from the shank in opposed, essentially parallel alignment;

said end portions biased inward by resilience of the shank;

means for removably retaining gems of various sizes and shapes within said finger ring;

a notch grooved in each said end portion near the shank end; and, wherein said means for removably retaining comprises a bezel encasing a gem mounted in the bezel, said bezel having protruding ears and adapted to snaplock into the notches of the end portions for interchanging gems.

3. The finger ring of claim 2, further comprising a bezel having an open top, open bottom and sidewalls, said bezel generally rounded to encase a gem and to retain the gem therein; the protruding ears of the bezel having a rounded periphery and projecting from the sidewalls of the bezel; each of said rounded ears graduated from a wider portion near said open top of the bezel to a narrow portion near said open bottom of the bezel; and, each said notch grooved in each said end portion near the shank end having a wider portion near the shank end and a narrower portion near the shank adapting the bezel to snaplock into, and be retained by, said ring.

4. A finger ring for interchangeable gems, said ring having an arcuate, resilient shank with an opening defined by spaced apart shank ends, comprising:

said shank bent to form a pair of end portions, each end portion extending outward from the shank in opposed, essentially parallel alignment;

said end portions biased inward by resilience of the shank;

means for removably retaining gems of various sizes and shapes within said finger ring, further comprising:

an essentially hemispheric depression carved in each end portion near the shank end forming a bezel platform integral with the end portion; said depression defining an internal cavity and having a circular edge at the periphery of said platform;

a notch grooved in each said end portion near the shank end, said notch formed within the circular edge of said bezel platform;

a bezel encasing a gem mounted in the bezel, said bezel having protruding ears adapted to snaplock into the notches of the end portions for interchanging gems; and, wherein said means for removably retaining comprises the inward compression of the end portions on an ornamental ball held in the cavities of said bezel platforms integrally formed in the end portions or said inward compression upon the bezel snaplocked in the ring.

* * * * *